US009701327B2

(12) United States Patent
Hochman et al.

(10) Patent No.: US 9,701,327 B2
(45) Date of Patent: Jul. 11, 2017

(54) CURRENT SENSOR FOR MONITORING A WAYSIDE SIGNAL LAMP FOR A POSITIVE TRAIN SYSTEM

(71) Applicant: ALSTOM TRANSPORT SA, Levallois-Perret (FR)

(72) Inventors: Robert I. Hochman, Pittsford, NY (US); Bruce Vernon Johnson, Pittsford, NY (US)

(73) Assignee: ALSTROM TRANSPORT TECHNOLOGIES, Levallois-Perret (FR)

( * ) Notice: Subject to any disclaimer, the term of this patent is extended or adjusted under 35 U.S.C. 154(b) by 661 days.

(21) Appl. No.: 13/952,064

(22) Filed: Jul. 26, 2013

(65) Prior Publication Data

US 2015/0028163 A1 Jan. 29, 2015

(51) Int. Cl.
*B61L 27/00* (2006.01)
*B61L 5/18* (2006.01)

(52) U.S. Cl.
CPC ..... *B61L 27/0088* (2013.01); *B61L 5/1881* (2013.01)

(58) Field of Classification Search
CPC ..... B61L 27/00; B61L 15/0036
See application file for complete search history.

(56) References Cited

U.S. PATENT DOCUMENTS 5,099,222 A * 3/1992 Campagna ..... B60Q 1/38 340/457
6,575,011 B1 * 6/2003 Busby ..... G01N 3/56 73/7
6,984,979 B1 * 1/2006 Edel ..... G01R 15/185 324/253
2011/0144933 A1 * 6/2011 Hoelscher ..... G01R 35/00 702/64
2011/0276285 A1 * 11/2011 Alexander ..... B61L 5/1881 702/58
2012/0319674 A1 * 12/2012 El-Essawy ..... G01R 35/04 324/74
2013/0119975 A1 * 5/2013 Nakajima ..... G01R 15/202 324/117 R
2014/0225593 A1 * 8/2014 Nakajima ..... G01R 15/20 324/117 R

OTHER PUBLICATIONS

Professional Plastics, Micarta Laminates—Various Grades Technical Information, Copyright Professional Plastics, Inc. 2001.*

* cited by examiner

*Primary Examiner* — Patrick Assouad
*Assistant Examiner* — Haidong Zhang
(74) *Attorney, Agent, or Firm* — Davidson, Davidson & Kappel, LLC

(57) ABSTRACT

A sensor for monitoring the current flowing in a wire of a circuit is provided. The sensor includes a variable inductance contactless current detector to sense the current flowing in the wire, serially connected to an internal power source and a resistor to form a voltage divider circuit. The sensor also includes a voltage detector to monitor the voltage level across the resistor and generate an output signal. A system is also provided.

8 Claims, 5 Drawing Sheets

CURRENT SENSOR FOR MONITORING A WAYSIDE SIGNAL LAMP FOR A POSITIVE TRAIN SYSTEM

BACKGROUND

The present invention concerns a safety device for the railroad industry.

With the signing of the Rail Safety Improvement Act, in October 2008, the railroad industry will need to be "Positive Train Control" compliant throughout the United States by 2015.

The term "Positive Train Control" (PTC) means that a system must be designed to prevent: train to train collisions; over speed derailments; incursions into established work zone limits; and movement of a train through a switch left in the improper position.

To satisfy these requirements, a number of new types of devices are needed to provide complete PTC systems.

In particular, there is a need for a device to capable report to an on-board locomotive subsystem the status of a wayside signal supplied to a wayside signal lamp. The wayside signal allows the determination whether the locomotive movement is in agreement with the condition of the railroad. The report of the status of this wayside signal is necessary to satisfy the fundamental requirements of any PTC solution.

SUMMARY OF THE INVENTION

An object of the present invention is to provide a response to this need.

The present invention provides a current sensor for monitoring the current flowing in a wire of a circuit, the current sensor includes a variable inductance contactless current detector to sense the current flowing in said wire, serially connected to an internal power source and a resistor to form a voltage divider circuit and a voltage detector to monitor the voltage level across the resistor, and generate an output signal.

The variable inductance contactless current detector according to the invention, called VCS for "Vital Current Sensor" throughout this document, is a stand-alone device used to monitor, in an "overlay" configuration, the status of the wayside signal of an associated wayside signal lamp.

This may be accomplished by measuring the current drawn by the wayside signal lamp, which corresponds to the wayside signal.

The output signal of the VCS represents the status of the wayside signal.

The output signal of the VCS is intended to drive an input of a wayside interface unit (WIU), which converts the analog output signal of the VCS into a communication message, which is eventually delivered to an onboard locomotive subsystem. The details of the operation of the WIU are outside the scope of the invention.

BRIEF DESCRIPTION OF THE DRAWINGS

A preferred embodiment of the present invention will be elucidated with reference to the drawings, in which.

DETAILED DESCRIPTION

Figure 1:
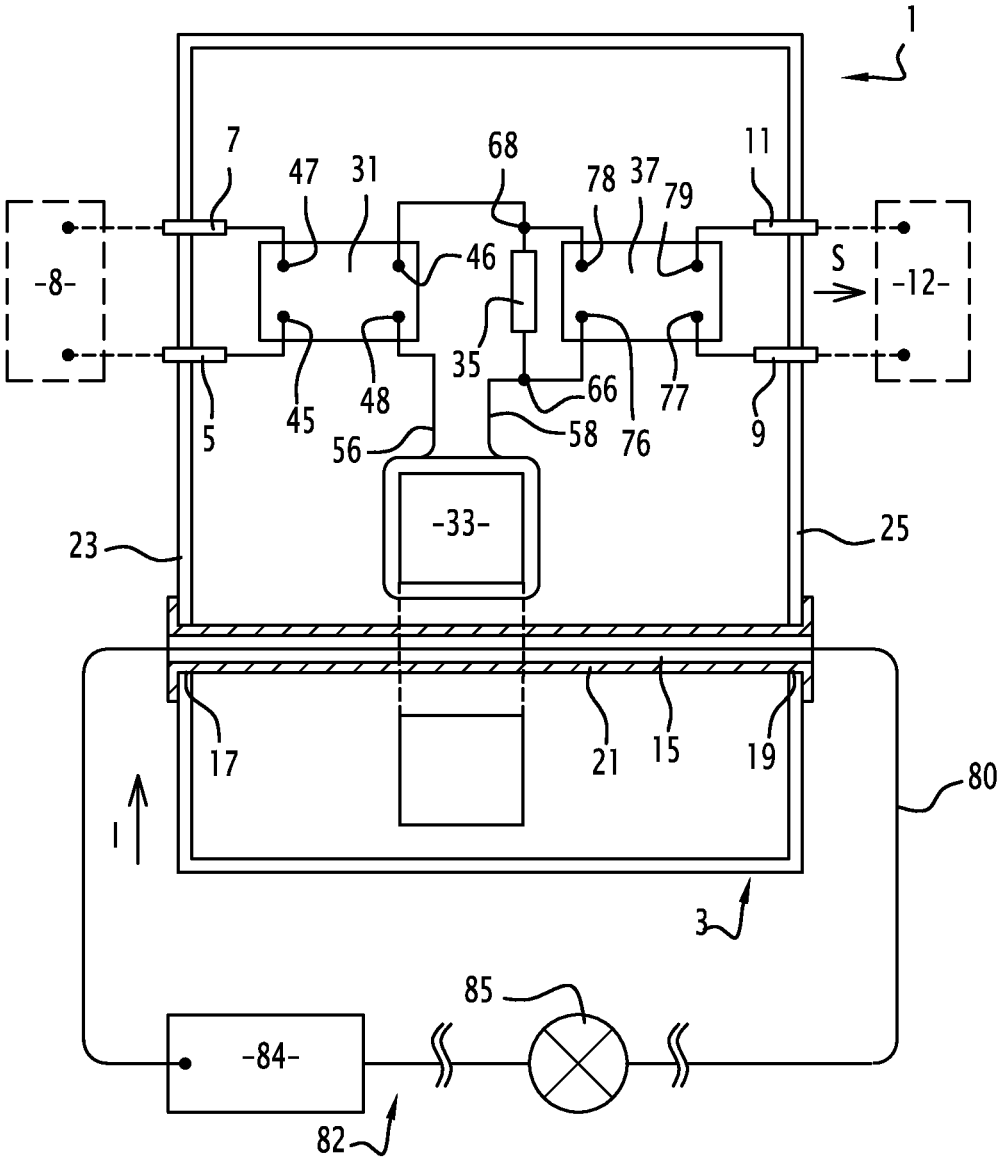
FIG. 1 represents a Vital Current Sensor according to a preferred embodiment of the invention.

As shown in FIG. 1, the VCS 1 comprises a housing 3, for example made of plastic, which is provided with:

power input connectors 5 and 7, to be connected to an external power source 8, for supplying a nominal 12V DC to the VCS; signal output connectors 9 and 11, to be connected with corresponding input connectors of a WIU 12, for the exchange of an output signal S generated by VCS 1; and, a wire passage 15.

The passage 15 extents between two through holes 17 and 19, provided on two opposite walls of the housing 3. The passage 15 is realized by a tubular sheath 21, made for example of Garolite (a paper-based material that is lighter than metal but denser and stronger), whose ends are maintained in said through holes 17 and 19 and which connects one external face 23 of the housing 3 to the opposite external face 25.

Inside the housing, the VCS 1 comprises:

a voltage source 31;

a magnetic core 33;

a fixed resistor 35, whose resistance is R1; and, an output circuit 37.

The voltage source 31 is a quadrupole, whose first and second input terminals, 45 and 47, are respectively connected to the power input connectors 5 and 7. The voltage source 31 has first and second onput terminals 46 and 48.

The magnetic core 33 surrounds the sheath 21 of the passage 15, so that the passage goes through the magnetic core center.

A primary winding 53 of the magnetic core 33 has a first terminal 56 connected to the second output terminal 48 of the voltage source 31 and a second terminal 58 connected to a first terminal 66 of the fixed resistor 35.

The second terminal 68 of the fixed resistor 35 is connected to the first output terminal 46 of the voltage source 31.

The output circuit 37 is a quadrupole. Its first and second input terminals, 76 and 78, are connected respectively to the first and second terminals 66 and 68 of the fixed resistor 35. Its first and second output terminals, 77 and 79, are connected respectively to the output connectors 9 and 11.

In a typical application, the VCS 1 is used in combination with a WIU 12. Consequently, the output connectors 9 an 11 provided on the housing 3 are connected to input connectors provided on the WIU 12. The output signal S generated by the VCS 1 is thus transmitted to the WIU 12.

The VCS 1 is able to sense the current I flowing through a wire 80 of a wayside circuit 82 connecting a lamp driving unit 84 to a wayside signal lamp 85. In the typical setup the wayside signal lamp 85 is an 18 W or a 25 W lamp.

The lamp driving unit 84 may drive the wayside signal lamp with either a Direct Current or an Alternating Current. Both currents can be controlled either to be ON steady, or modulated ON and OFF to produce a flashing indication, typically at a 1 Hz rate.

Figure 2:
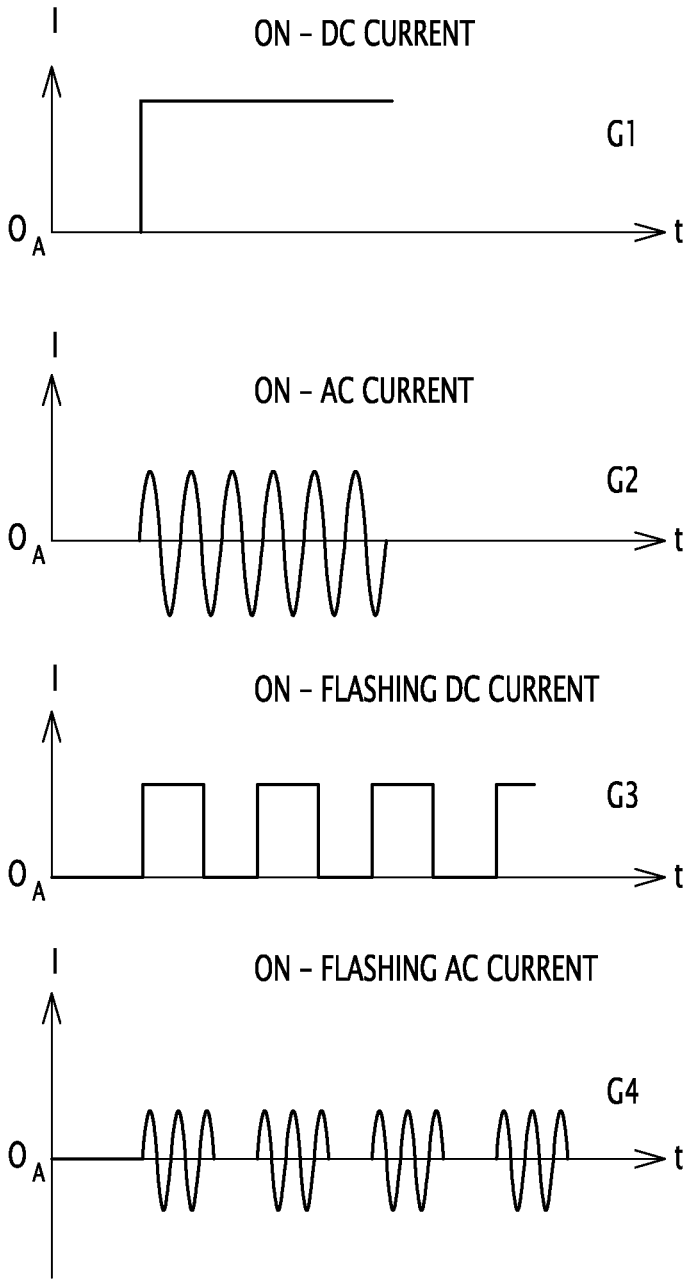
FIG. 2 shows graphs illustrating the various types of current waveforms the VCS will respond to (both AC and DC, steady state and modulated)

FIG. 2 depicts the various types of current the VCS 1 can detect.

The first graph G1 of FIG. 2 depicts a DC current transitioning from the OFF state to the ON state.

The second graph G2 of FIG. 2 depicts an AC current transitioning from the OFF state to the ON state.

The third graph G3 of FIG. 2 depicts a modulated DC current cycling between the OFF state and the ON state.

The fourth graph G4 of FIG. 2 depicts a modulated AC current cycling between the OFF state and the ON state.

The wire 80 is threaded through the VCS 1, in the passage 15.

For the installation, the wire 80 is disconnected from at least one of the connection points in the wayside circuit 82, inserted through the passage 15 of the VCS 1, and then reconnected to an original connection point.

The core 33 is used as a variable impedance component, whose impedance L1 is controlled by a secondary "winding". This secondary winding is realized by the wire 80 being passed through the magnetic core center.

Thus inductor L1 and fixed resistor R1, connected in series, compose a voltage divider circuit supplied by voltage source 31.

The output circuit 37 monitors the voltage V developed across the fixed resistor 35, and generates an output signal S when the monitored voltage V exceeds a preset threshold $V_0$, corresponding to a preset threshold $I_0$ for the current I in wire 80. This threshold $V_0$ is defined by the passive components selected to make the output circuit 37.

Figure 3:
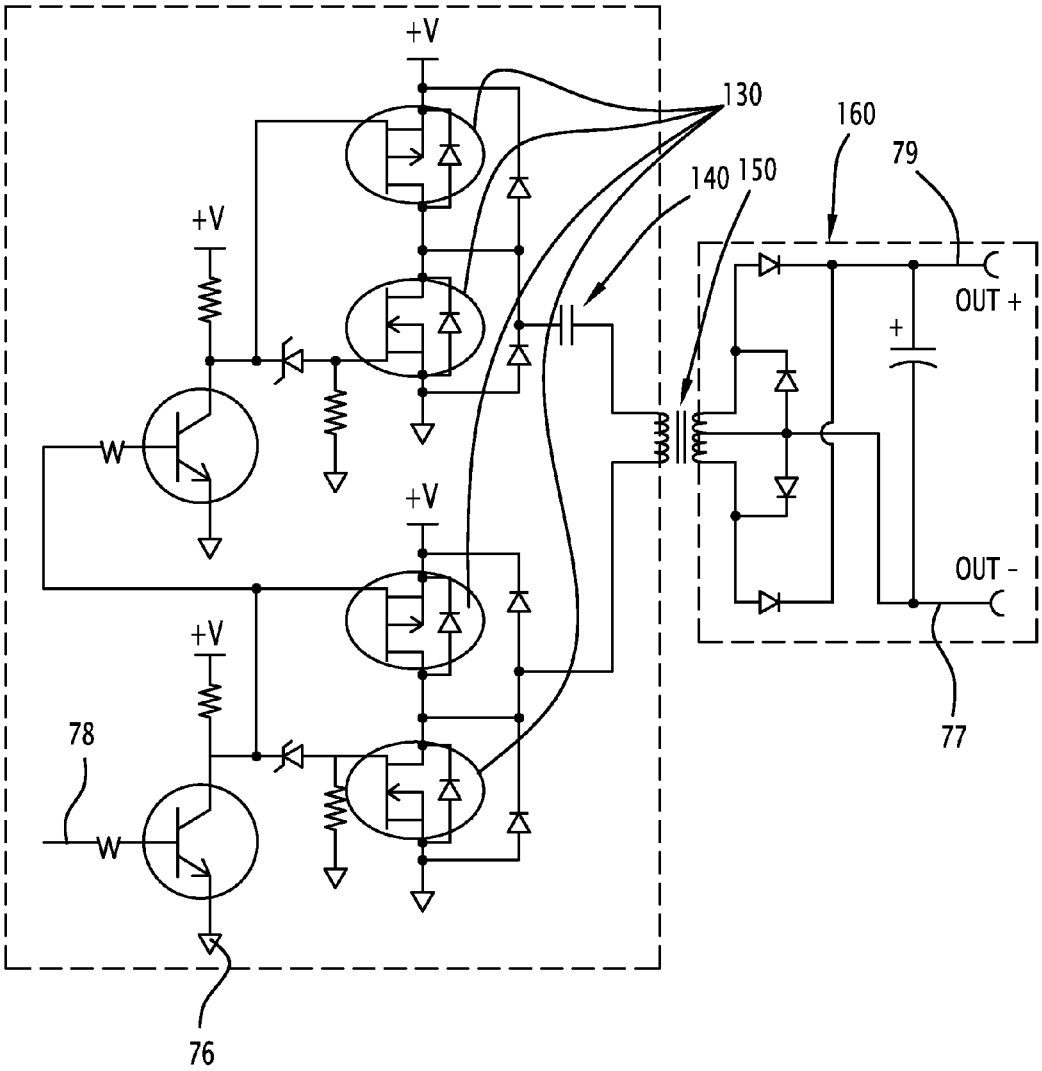
FIG. 3 is a circuit illustrating the major components of the output circuit responsible for generating the DC output voltage.

An illustrative example of a preferred embodiment of output circuit 37 is shown in FIG. 3. Output circuit 37 consists of a driver stage 130, configured as a bridge driver, a series resonant L-C tuned circuit, made of a capacitor 140 and a transformer 150, and an output block made of a rectified DC output 160, sufficient to energize an input circuit of the WIU.

The AC voltage V developed across the fixed resistor 35 is applied to the input 78 of the driver stage 130, resulting in both sides of the transformer 150 primary and series capacitor 140 being driven between +V_DRIVE and COMMON. The voltage produced across the transformer 150 secondary is the product of twice the input voltage and the amplification factor of the series resonant L-C tuned circuit at resonance divided by the turns ratio of transformer 150. If the input frequency departs from the resonant frequency of the series resonant L-C tuned circuit, the amplification factor rapidly decreases and the output voltage reduces accordingly, de-energizing the WIU input circuit.

In the preferred embodiment, the output signal S generated by the output circuit 37 is a DC output voltage: when the current I is above the threshold $I_0$, the output of circuit 37 is driven to an ON (permissive) state. In this state, the output circuit 37 provides a nominal output signal S of 12V DC; on the contrary, when the current I falls below the threshold $I_0$, the output is driven to an OFF (non-permissive) state. In this state, the output circuit 37 provides a nominal output signal S of 0V DC.

During operation, when the current I flowing in the wire 80 is null (i.e. the lamp 85 is de-energized), the impedance L1 of the magnetic core 33 is relatively high with respect to the fixed resistance R1. The majority of the signal amplitude from the voltage source 31 is divided primarily across L1 (i.e. the core). The output circuit 37 monitors the voltage across the fixed resistor R1, and since this voltage is below the voltage threshold $V_0$ there is no output from the VCS 1.

As the current level increases in the wire 80, the magnetic core 33 saturates and its impedance L1 decreases. This in turn increases the voltage level across the fixed resistor 35. Once this voltage V is of a sufficient level, the output circuit 37 activates and generates an output signal S.

Figure 4:
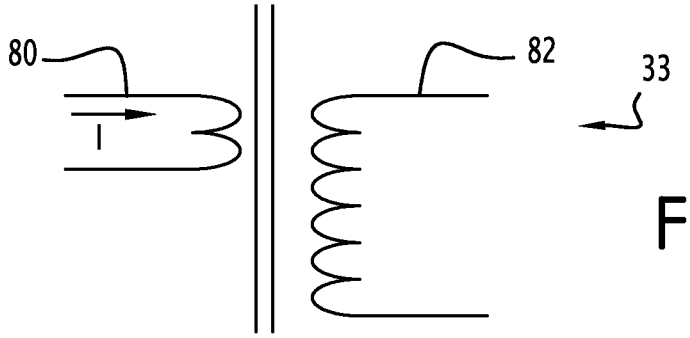
FIG. 4 is a graph representing the output signal of the VCS of FIG. 1 relative to the current flowing in the monitored wayside lamp.

FIG. 4 shows schematically the operational structure of the magnetic core 33, with the field lamp wire 80 represented as a control winding on the left, and a inductance winding 82 on the right.

Figure 5:
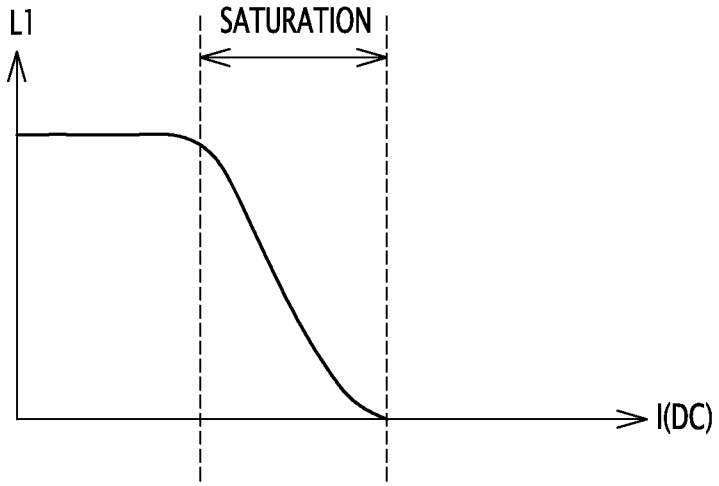
FIG. 5 is a graph illustrating the general relationship of DC current on the control winding of the sensing inductor to its inductance value.

As DC current I in the control winding increases, the inductance L1 of the inductance winding remains relatively stable until the magnetic core enters into saturation. Once in saturation, the inductance L1 of the inductance winding, and hence its corresponding impedance, drops dramatically as illustrated in FIG. 5.

When applied in the VCS, the signal lamp current I is used as the control winding current. As the lamp current I increase, the inductance L1 decrease once the core goes into saturation and the VCS output is enabled as described in the preceding paragraphs above.

In order to optimize the effect, the magnetic core 33 is designed to switch from a non-saturate state to a saturate state when the monitored current I moves above the predefined threshold $I_0$.

Figure 6:
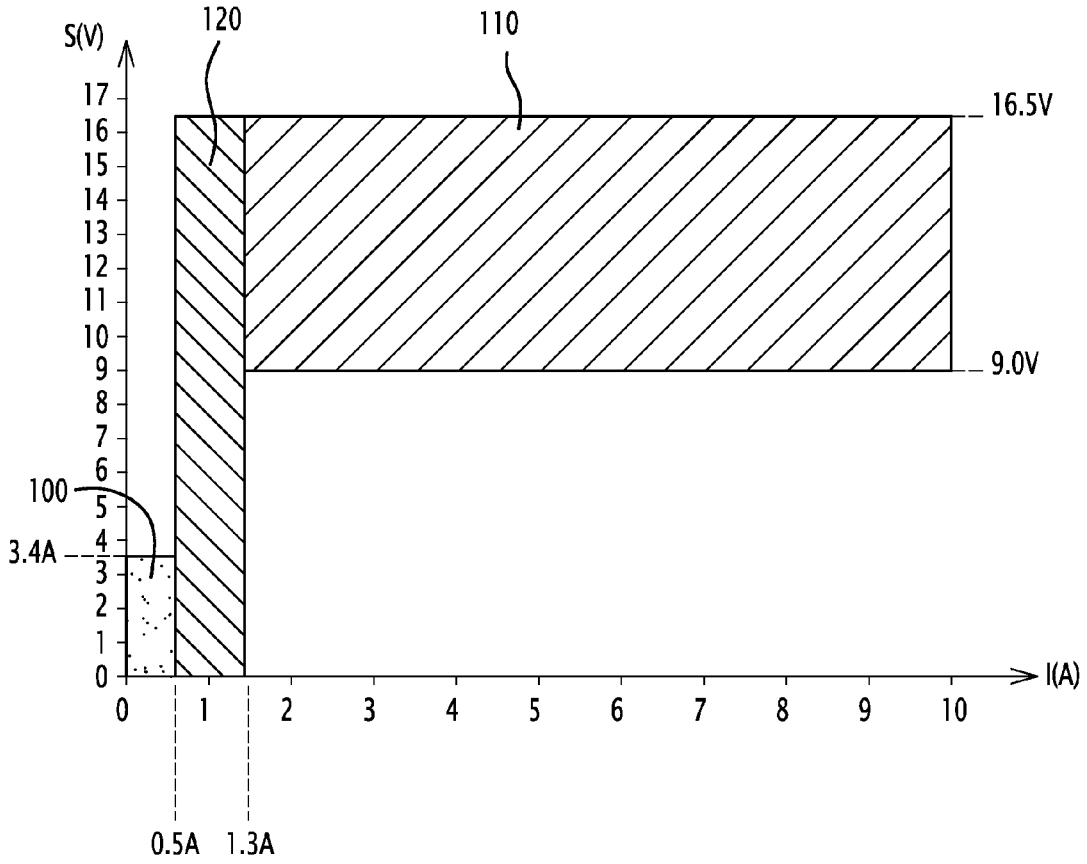
FIG. 6 is a graph illustrating the Current Sensor's transfer function of input sensed current to output voltage.

FIG. 6 graphically shows the relationship between the current I in the wayside signal lamp 85 and the voltage of the output signal S generated by the VCS 1.

During operation, when the current I is in the range from 0 to 0.5 A, the output signal S voltage must not exceed 3.4V (i.e. the OFF-state) (zone 100 in FIG. 2).

When the lamp current I exceeds 1.3 A, the output signal S voltage can be any value between 9V DC and 16.5V DC (i.e. the ON-state) (zone 110 in FIG. 2).

In the range of the current I between 500 mA and 1.3 A, the output signal S is indeterminate and can be anywhere between 0V and 16.5V DC (zone 120 in FIG. 2).

With this behavior, the VCS 1 complies with the safety requirements for a device intended to be integrated in a PTC system, and, as such is considered as a "fail-safe" device. Indeed, under no circumstances the output signal S exceeds 3.4V DC when the current being monitored is below 0.5 A DC or 0.5 Arms; under no circumstances the output signals "flashes" (i.e. oscillates between the ON state and the OFF state) when the current being monitored is either constantly below or constantly above the detection threshold (this requirement originating from the fact that, in North American signal applications, a flashing signal aspect is considered to be more permissive than a steady, i.e. non-flashing, signal aspect); a failure of the VCS 1 which generates an output signal when the monitored current is above the preset threshold is considered to be an acceptable failure (i.e. safe side).

Any current I that causes the saturable inductor made of the magnetic core to change its impedance will cause the VCS output circuit to energize.

When the VCS senses an AC current I in the wire 80, the AC current waveform travels from 0 current, to the positive peak current, back to zero current, then to peak negative current, finally returning to 0 current. This sequence is repeated for as long as the AC current is present. At both the positive and negative peaks, the saturable inductor is in the saturation state. During the transition time, the saturable inductor is in various states of intermediary saturation, including not saturated at all. At this time, the VCS output circuit turns off.

Figure 7:
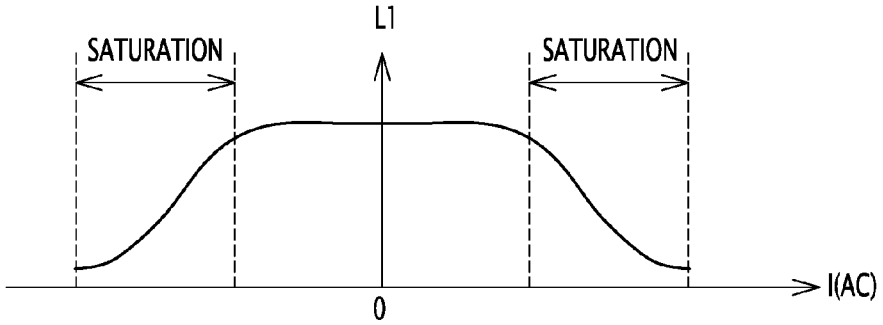
FIG. 7 is a graph illustrating the general relationship of AC current on the control winding of the sensing inductor to its inductance value.

The relationship between the inductance L1 and AC current I is shown in FIG. 7. The rate at which the core goes in and out of saturation is directly proportional to the frequency of the AC current I.

However, this is sufficient filtering in order the output block of the output circuit to maintain a value of the output voltage during this time. The end result is that the final output voltage from the VCS appears to be on steady when detecting AC current.

Unlike the condition when the lamp is driven with an AC current, when the lamp current is DC, the sense core is driven into a continuous state of saturation.

This allows the VCS to be used to detect the state of any signal lamp, to be either steady ON, FLASHING, or OFF. In the case where a railroad system uses flashing aspects, signals will typically flash at a rate of 1 Hz with a nominal duty cycle of 50.

In combination with a WIU, a single VCS is used for each wayside signal lamp to be monitored.

The VCS is a unique device suitable for use in "fail-safe" railways applications. In addition, any failure of the VCS will have no impact on the operation or performance of the wayside signal lamp being monitored. The isolation between the monitored system and the VCS is extremely high.

The VCS is a contactless monitoring component, able to detect current on a wire without the need of a physical connection. The installation of the VCS does not require any electrical connection to the circuit to be monitored. So, it is very easy to put in place.

Compared to the prior art, the design of the present sensor is simpler and only uses analog components. There is no dedicated active means, such as a processor, for the checking of the threshold.

What is claimed is:

1. A current sensor, complying with Positive Train Control requirements, for monitoring the current flowing in a wire of a circuit, the current sensor comprising:

a variable inductance contactless current detector to sense the current flowing in the wire, the variable inductance contactless current detector being a magnetic core, provided with a primary winding and a secondary winding, the secondary winding being made by said wire, the magnetic core being designed to switch from a non-saturate state to a saturate state when the current flowing in the wire moves above a predefined threshold;

an internal power source connected to the primary winding;

a resistor connected between one terminal of the internal power source and the corresponding terminal of the primary winding, the magnetic core acting as a variable inductance and the resistor, connected in series, forming a voltage divider circuit supplied by the internal power source;

a voltage detector to monitor the voltage level across the resistor and generate an output signal, such that when the current flowing in the wire is above the predefined threshold, the magnetic core is in a saturated state and the output signal is ON, and when the current flowing in the wire is below the fixed threshold, the magnetic core is in a non-saturated state and the output signal is OFF;

a housing provided with a passage going through said magnetic core and connecting a first face of the housing with a second face of the housing, opposite the first face, said passage receiving said wire in order the current sensor to monitor the current in said wire.

2. The current sensor of claim 1, wherein the output signal is between 0 and 3.4 V, when the monitored current is between 0 and 0.5 A and between 9 and 16.5 V DC, when the monitored current (I) is above 1.3 A.

3. The current sensor of claim 1, wherein the internal power source is intended to be connected to an external power source supplying 12 V DC to the current sensor.

4. The current sensor of claim 1, wherein the current sensor is a fail-safe device.

5. A system comprising:

a wayside circuit;

a wayside lamp;

a wire to connect the wayside circuit to the wayside lamp; and a current sensor according to claim 1 to monitor the current in said wire, for reporting the status of the wayside lamp and capable of monitoring the current drawn by the wayside lamp.

6. The current sensor of claim 1, wherein the passage extents between two through holes provided on the first and second faces of the housing, and is realized by a tubular sheath, whose ends are maintained in said through holes.

7. The current sensor of claim 6, wherein the passage is made of a paper-based material that is lighter than metal but denser and stronger.

8. The current sensor of claim 1, wherein the voltage detector is made of passive components, selected to defined said fixed threshold.

* * * * *